US007666040B2

(12) United States Patent
Arvidsson

(10) Patent No.: US 7,666,040 B2
(45) Date of Patent: Feb. 23, 2010

(54) WATERCRAFT SWIVEL DRIVES

(75) Inventor: Lennart Sven Mikael Arvidsson, Källered (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 11/585,060

(22) Filed: Oct. 23, 2006

(65) Prior Publication Data

US 2008/0146096 A1 Jun. 19, 2008

(51) Int. Cl.
*B63H 5/16* (2006.01)

(52) U.S. Cl. ..... 440/68

(58) Field of Classification Search ..... 440/51, 440/53, 69, 68

See application file for complete search history.

(56) References Cited

U.S. PATENT DOCUMENTS

| | | | | |
|---|---|---|---|---|
| 106,824 | A * | 8/1870 | Lewis et al. | 440/51 |
| 345,702 | A * | 7/1886 | Kunstadter | 440/51 |
| 1,007,583 | A | 10/1911 | Loetzer | |
| 3,515,087 | A | 6/1970 | Stuart | |
| 3,626,894 | A | 12/1971 | Stuart | |
| 4,622,016 | A | 11/1986 | Hankley | |
| 4,631,036 | A * | 12/1986 | Grothues-Spork | 440/66 |
| 4,689,026 | A | 8/1987 | Small | |
| 4,940,436 | A | 7/1990 | Newman | |
| 4,977,845 | A | 12/1990 | Rundquist | |
| 5,405,278 | A * | 4/1995 | Garland | 440/69 |
| 6,705,907 | B1 * | 3/2004 | Hedlund | 440/51 |
| 7,188,581 | B1 * | 3/2007 | Davis et al. | 114/285 |

* cited by examiner

*Primary Examiner*—Stephen Avila
(74) *Attorney, Agent, or Firm*—Martin Farrell

(57) ABSTRACT

Enhanced watercraft performance is provided by combinations of one or more inboard swivel propulsion drives and hull tunnels. A tunnel at the hull centerline with specific features provides performance advantages for a center swivel propulsion drive. Use of front propeller based traction propulsion is particularly advantageous in the swivel drive systems and allows the use of tunnels with improved tunnel conformations. Advantages of the traction swivel drive arrangements include minimization of hull space with smaller engine room volume, greater propulsion efficiency and improved watercraft handling.

24 Claims, 6 Drawing Sheets

WATERCRAFT SWIVEL DRIVES

FIELD OF THE INVENTION

This invention relates to watercraft propulsion systems, watercraft hulls, and to improvements of watercraft and their propulsion systems.

BACKGROUND

Steerable drives with traction propellers have recently been successfully adapted for inboard use, as described in U.S. Pat. No. 7,033,234, which is owned in common with the present application. In addition, U.S. Pat. Nos. 6,623,320; 6,705,907; and 6,783,410, describe the advantages of forward-mounted, or traction, propellers in producing greater efficiencies by working in undisturbed water.

The aforementioned U.S. Pat. No. 7,033,234 describes a system of inboard steerable drives located on either side of a mono hull centerline which provide enhanced maneuverability compared to a typical inboard fixed propeller shaft by directing propulsion force in a more effective way than does the combination of a propeller and a rudder.

Inboard propulsion systems for planing watercraft sometimes employ a cutout tunnel in the hull to keep hull draft to a minimum. See, for example, U.S. Pat. No. 3,515,087, which describes a deep-V planing hull with a water tunnel formed below the operating waterline in the aft region of the hull and open at the stern. Improvements to tunnel drives include, for example, adding a wedge in the propeller shaft tunnel aft of the propeller as described in U.S. Pat. No. 4,622,016. Tunnel hulls typically include a single fixed propeller drive.

SUMMARY OF THE INVENTION

The invention provides steerable drives on a watercraft hull having at least one tunnel. In a desirable embodiment, one steerable drive is positioned in a tunnel along the centerline of a monohull, preferably located adjacent or near to the watercraft transom. In another embodiment, two steerable drives are positioned on opposite sides of a centerline and within their own tunnels. In yet another embodiment, three steerable drives, including drive motors, are positioned in the hull and at least one of the three steerable drives is located within a tunnel. In another embodiment 3 or 4 steerable drives are positioned in the bottom of a hull that lacks a tunnel.

A further embodiment that alleviates problems in the art provides a planing watercraft, comprising a hull with a centerline that bisects the hull into starboard and port hull sections, a tunnel depression at the centerline, and a steerable drive with at least one attached propeller within the tunnel depression. The tunnel depth may be between 50% and 80% of one propeller diameter.

In another embodiment the fore end of the tunnel comprises a ramp having a slope of between 4 and 45 degrees. In yet another embodiment the tunnel has an exit cross section at the transom that is larger than the cross section of the forward sections of the tunnel. In yet another embodiment, swivel drives are used having pairs of counter-rotating propellers of smaller diameter compared to that used in single propeller designs.

Another embodiment provides a planing watercraft having a ratio of engine room volume to internal vessel volume of not more than 20%, comprising at least 3 swivel drives, a first swivel drive located on the starboard side of the watercraft, a second swivel drive located on the port side of the watercraft and a third swivel drive located at the centerline of the watercraft, and wherein at least one of the swivel drives is located in a tunnel depression of the hull. In a related embodiment, the tunnel depression has a rear section that comprises vertical lateral wall surfaces from the midsection to the transom and wherein the vertical lateral wall surfaces curve away from the centerline throughout a distance from the end adjacent to the transom line, of less than two propeller diameters.

Other embodiments will be appreciated by a skilled artisan upon reading this specification.

BRIEF DESCRIPTION OF THE DRAWINGS

The invention will be better understood with reference to the detailed description in conjunction with the appended drawings, in which.

DETAILED DESCRIPTION

Figure 1A:
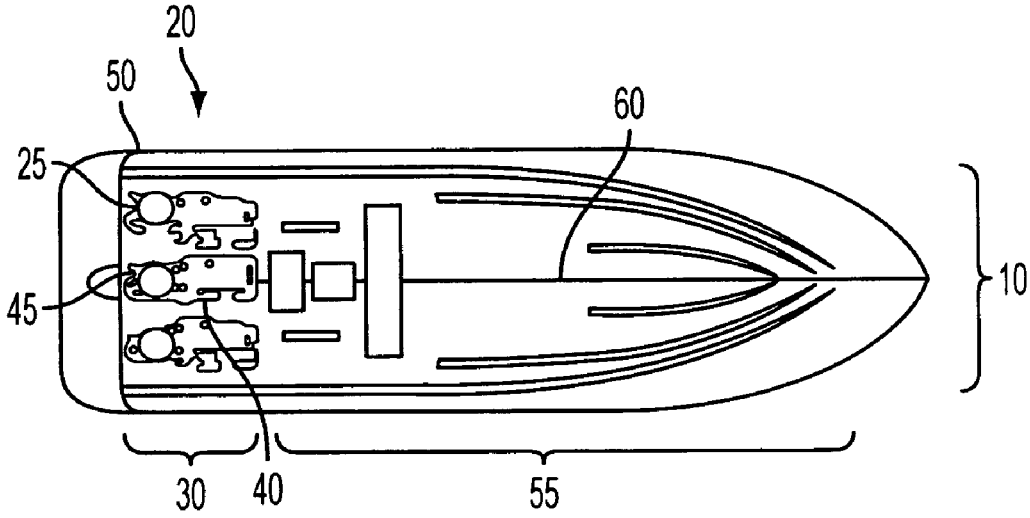
FIGS. 1*a*, 1*b* and 1*c* show top views of representative engine placements according to an embodiment of the invention.

In a broad aspect the invention is a watercraft that combines a single hull or a main hull having a tunnel and at least one swivel drive unit that is mounted in the tunnel. The at least one swivel drive attached to the hull preferably penetrates a hull bottom section via a vertical shaft. Other configurations such as multiple swivel drives in traction configuration (propellers in front) with an optional center tunnel are contemplated and described here. The swivel drive connects to at least one steerable propeller unit. The propeller generates thrust, generally horizontally, to move the watercraft. Swiveling the propeller unit directs the thrust to provide steering and other performance advantages. A variety of advantageous embodiments based on this insight are detailed next, starting with a broader description of hull positions of the swivel drives, the use of multiple drives optionally without a tunnel, positioning of drives within tunnels of desirable shape and dimensions, and further refinements based on a working example and analysis.

Hulls with Swivel Drives

One embodiment of the invention provides a planing watercraft having at least one hull with a centerline and one or more swivel drives attached to the hull bottom. Planing and steering are achieved by orientation of the one or more drives that are located on the hull, wherein at least one drive can swivel on a vertical axis as described, for example, in U.S. Pat. No. 7,033,234, the contents of which is specifically incorporated here by reference in its entirety. In a desirable embodiment, a swivel drive attached to the hull comprises a motor such as an internal combustion engine located in the watercraft and attached via a transmission and seal through the hull below to a drive shaft of a propeller that is mounted in a unit below the hull. The propeller drive shaft is approximately horizontal and preferably provides horizontal thrust.

The swivel drive seal allows swivel of the unit with attached propeller around a roughly vertical swivel axis.

The swivel drives preferably are traction drives, such as described in the aforementioned U.S. Patent. Generally, steering gear allows the submerged drive unit to be turned on a swivel axis. The swivel drive preferably is mounted on a generally horizontal, flat section of the hull.

The hull mounted drive preferably can swivel in both directions on the swivel axis. The degree of swiveling may differ at different vessel speeds and for different vessel designs. In general, swivel drives can generate steering forces at planing speeds for tighter turns than are possible with rudders. In addition, at displacement speeds, and particularly in docking maneuvers, swivel drives can produce lateral vessel movement without turning, which is a decided advantage in docking in tight spaces.

An important parameter within the combination of swivel drive(s) attached to a common mono hull is optional drive trimming. Steering under power produces undesirable moments, which can be alleviated by trim. Bottom mounted swivel drives in particular can benefit from trim applied to each swivel drive. This is especially helpful for the high efficiency, lower drag swivel drive embodiment.

Accordingly, thrust angle with respect to keel preferably is altered by trimming. Passive trim may be set manually and/or may be active under control of one or more motors or actuators. The propeller attack angle may be modified and/or a control surface angle trim can be set. A power foil for example, positioned in front of or (more preferably) behind the propeller(s) may act as a horizontal control surface. The propeller angle of attack may be altered by adjusting the tilt of the propeller turning axis, directly or indirectly.

Trim angle may be set by up to 30 degrees. A trim angle of up to 4 degrees is preferred to provide a measurable effect on watercraft performance. Trim angles of up to 15 degrees provide distinctly greater effects on pitch, and are desired, particularly as the trim control surface area decreases. Those skilled in the art will appreciate controlling smaller trim control surfaces with the larger stated trim angles and vice versa. Also, extreme trim angles that exceed 15 degrees up to 45 degrees even up to the vertical are preferred for extreme conditions such as very low speeds. Because gears may be placed at the hull bottom in a preferred arrangement, trim may be carried out by tilting within the lower portion of a propulsion unit below the hull, for example, via a universal joint. Other arrangements are envisioned, where a larger portion of the propulsion unit is tilted. Trim of one or more hull-attached swivel drives as taught herein, provides another control dimension and may be combined with steering control for enhanced watercraft performance.

Multiple Swivel Traction Drives on a Hull

Multiple swivel traction drives on a common hull is particularly preferred because of performance advantages from: i) adding more blade area in contact with water; ii) distributing thrust to multiple locations, and iii) greater control of volume and weight distribution within a hull from the drive units. Exemplary placements of three swivel drives on a hull are shown in FIG. 1A through 1C.

FIG. 1A shows a planing watercraft with monohull 10 having three propulsion units 20 located in aft section 30. Swivel portions 25 (labeled for the top unit in this figure) connected at the left side of propulsion units 20 penetrate the hull 10 and position their attached propellers (not shown) below hull 10. The attached propeller(s) preferably are mounted at the front of an elongated portion of the drive that is submerged below hull 10. Steering is accomplished by swiveling the elongated portion to a desired vector. Alternatively, propellers are in pusher configuration, and located at the aft end of the shaft (below the hull). FIG. 1A shows center propulsion unit 40 with swivel portion 45, adjacent to transom 50. Forward of the propulsion units is large hull area 55 that typically assumes 80% or more of the total forward linear distance of center hull line 60.

Figure 1B:
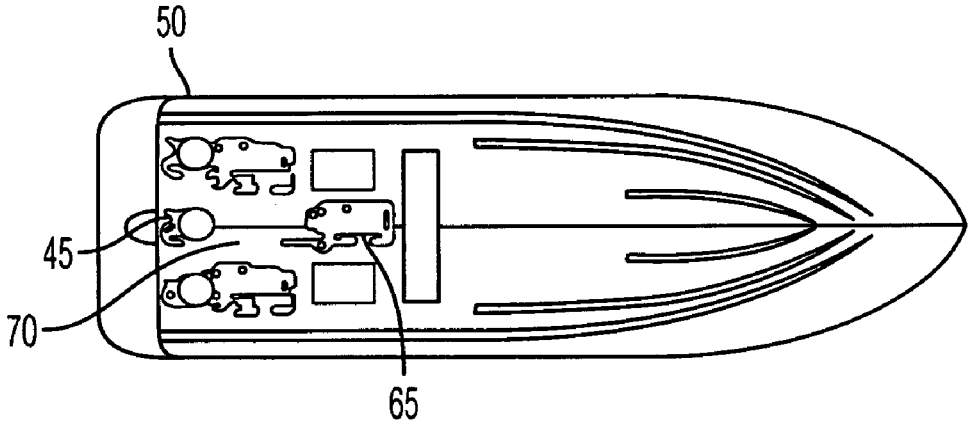
Figure 1C:
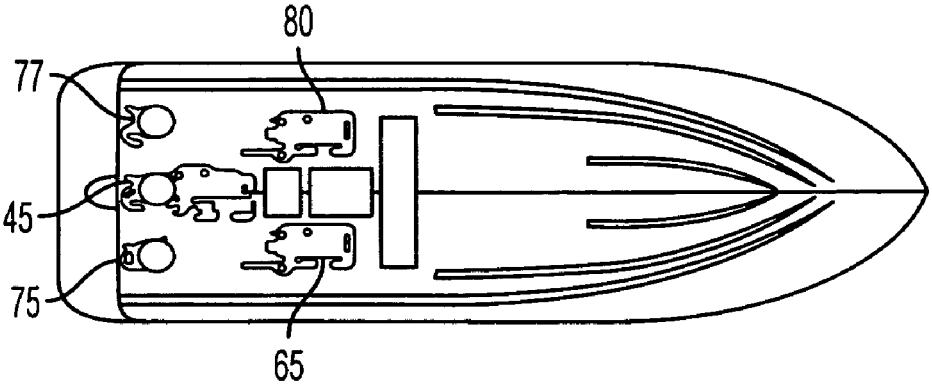

FIG. 1B shows an alternative placement of propulsion unit swivel portion 45 separated from its motor 65 via rotating shaft 70. This arrangement distributes weight more towards the vessel hull center, while positioning a tunnel drive, including submerged part of swivel portion 45, near transom 50. FIG. 1C shows an alternative separation of propulsion unit swivel portions 75 and 77 from their respective motors 65 and 80 by a distance.

The preferred embodiments shown in FIG. 1, and particularly FIG. 1A, free up space along centerline 60 and forward of the engines. In another embodiment (not shown) the three motors are replaced by a single motor that supplies power to the three propulsion units. In yet another embodiment, each propulsion unit swivel portion includes an electric motor, and a single motor generator (such as a diesel motor generator) provides at least some of the power to the electric motors. The electric motor(s) optionally are below the hull in a streamlined propeller mount. Desirably, the swivel drive motors are located below the deck, as made possible by the lower propeller positioning.

In a further embodiment, four swivel drives are used, with two on one side of the centerline and two on the other side. Preferably, either no tunnel is used, with drives positioned perpendicular to the hull, or only partial cutouts (tunnels with no depth or shallow depth on one side compared to the other side) are used.

Addition of Hull Tunnel

In a preferred embodiment, the combination of swivel drive and hull further includes a hull tunnel that at least partially encloses the propeller of a swivel drive. In a basic embodiment, one swivel drive unit is mounted in a single tunnel at the centerline. Optionally, this may be combined with two additional drives, one on each side of the centerline, that preferably also are swivel drives. The hull tunnel (or tunnels if added for $2^{nd}$ and $3^{rd}$ drives) are aligned with the long axis of the hull, and have desirable shapes and dimensions to accommodate chosen propeller sizes, propeller mounting style (puller versus pusher), and vertical displacement depth, as described further with reference to FIGS. 2 through 6.

Figure 2A:
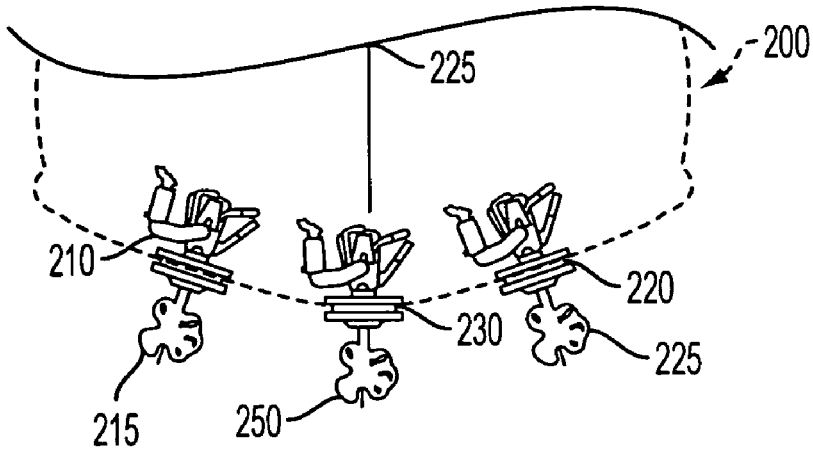
FIGS. 2*a*, 2*b* and 2*c* show rear views of representative swivel drive placements for hull cross sections, including hull tunnels in FIGS. 2*b* and 2*c;*
Figure 2B:
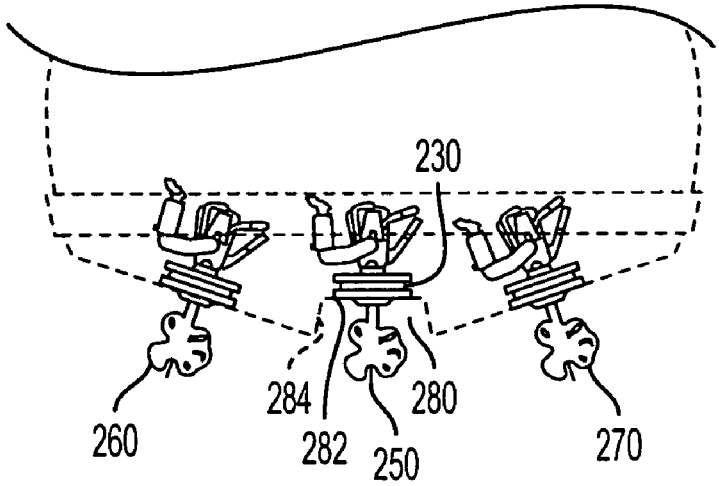
Figure 2C:
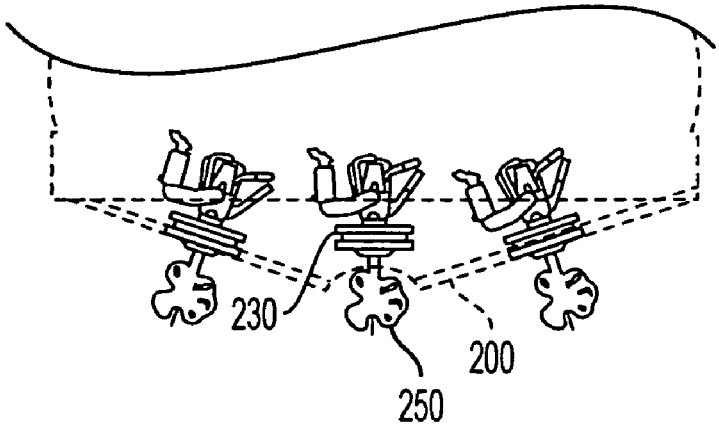

FIGS. 2A through 2C show the vertical placement of three side by side swivel drives in a planing hull in an end schematic view. FIG. 2A depicts hull 200 with port swivel drive 210 and starboard swivel drive 220, which are positioned a common distance from center line 225. Swivel drive 230 is on centerline 225. In an embodiment, swivel drives 210 and 220 operate their submerged propeller portions 215 and 225 through a larger swivel angle compared to swivel drive 230. In another embodiment, swivel drives 210 and 220 operate their submerged propeller sections through a smaller swivel (steering) angle range compared to that of swivel drive 230.

As shown in FIG. 2A, centerline positioned swivel drive 230 may include a propeller (250) having the same diameter as, and located below the other laterally positioned swivel drive propellers (215 and 225). In an embodiment, propeller diameter or diameters used for a third centerline located swivel drive 230 are smaller than that for drives 210 and 220. This latter embodiment minimizes the difference in depth among the propellers.

In an embodiment a third centerline located swivel drive 230 operates more propellers of smaller diameter than the other swivel drives which do not have tunnels and are positioned higher. For example, single propeller swivel drives may be used at starboard and port positions, and a double propeller of smaller total diameter may be used at the center position. In yet another embodiment, a center swivel drive operates a smaller diameter propeller at a higher rotation rate compared with propellers at the starboard and port positions.

Without wishing to be bound by any one theory for the embodiment of multiple tunnel drives as described here, it is believed that using multiple drives to provide increased propeller surface area with control of thrust vector via swivel capability results in extraordinary tight steering control. The combination of a swivel drive in a tunnel with a traction propeller arrangement benefits from the high traction and smaller blade, particularly in view of the need to minimize tunnel volume. Pairs of swivel drives (e.g. starboard and port drives) with two larger propellers in sets of 5 blades and 6 blades, for example, may be combined with a center drive having two smaller diameter propellers with in sets of 7 blades and 8 blades. Other combinations that result in the desirably greater surface area compared to one or two single propeller drive units are contemplated but are not listed here due to space considerations.

In an alternative three drive embodiment, a center drive is fixed within a tunnel. In an embodiment, three drives are positioned at the same vertical depth. Desirably, the outer units drive steering and/or trim are slaved (controlled coordinately) while a center drive may be controlled independently.

FIG. 2B shows a desirable placement of swivel drive 230 within hull tunnel 280. This allows relatively higher positioning of propeller 250 and a smaller draft. This figure shows propeller 250 at the same vertical height as propellers 260 and 270. The illustrated relationship between the center and lateral propellers is by way of example; the height may be above or below this position while within a tunnel drive in other embodiments. As shown, the spacing between propeller blade tip and hull may be the same for all three swivel drives. The spacing between the blade tips of the center propeller 250 and the hull may be less to allow for a measurably smaller tunnel width, which gives improved buoyancy.

Preferably, tunnel 280 shown in FIG. 2B is a single depression that begins in front of swivel drive 230 and terminates aft of drive 230 into the transom. Preferably exit floor 282 of tunnel 280 is horizontal and straight, as shown. Tunnel exit walls 284 are drawn straight in this figure, but may be curved or have another shape. The tunnel bottom angle formed between exit floor 282 and exit wall 284 is shown as a defined angle of about 97 degrees, but may also be different. A skilled artisan should select the exit width of tunnel 280 at the transom based on the swivel mount connector plate size, the size of the propeller and/or by the degree of steering used for drive 230.

In an embodiment a single tunnel is used for a centerline mounted swivel drive and other drives are mounted perpendicular to their hull positions, but may not be exactly vertical, due to the hull deadrise. In an advantageous embodiment, all three drives are positioned vertically and preferably with their propellers in the same horizontal plane. In this latter embodiment, the starboard and port swivel drives may be located within tunnels that typically are less deep than the center tunnel. Because of the deadrise, the third, center positioned swivel drive preferably is in a symmetrical and deeper tunnel, whereas the two side drives are in non-symmetrical tunnels having a smaller average depth. These side tunnels, in an embodiment, are deep enough to enclose at least part of their respective propellers such that each propeller protrudes to the same extent below the surrounding hull. In an embodiment, all three drives are vertical, but the side drives are at a common higher horizontal location with respect to the center drive.

Drives 210, 220 and 230 seen in FIG. 2 swivel over a continuously changing range that depends on watercraft speed and/or propeller speed as described above. In this regard, the tunnel width and shape may be selected to accommodate the swivel drive mounting plate or the amount of movement of the submerged lower unit of swivel drive 230. In an embodiment, the tunnel width is determined by the size of the swivel drive mounting flange plus a small additional radius of typically about 1-3 inches, 2-4 inches, or 3-5 inches or as otherwise needed to attach the mounting plate into the hull bottom. These additional spaces are desired for inserting tools for installation and maintenance. Larger steering angles for drive 230 are allowed by increasing width of tunnel 280 and/or shape of exit from tunnel 280 into the transom as will be appreciated by a skilled artisan.

FIG. 2C shows drive placement similar to that of FIG. 2B, except that the tunnel profile for propeller 250 is rounded and the propeller tip is closer to hull 200. In yet another embodiment drive 230 moves vertically to adjust immersion depth of propeller 250. In another embodiment, (not shown), drives 210 and 220 are positioned flat and horizontally and all swivel drives swivel their lower units in the same plane, which may differ from the hull surface and is not affected by deadrise angle.

Hull Tunnel Configurations

Figure 3:
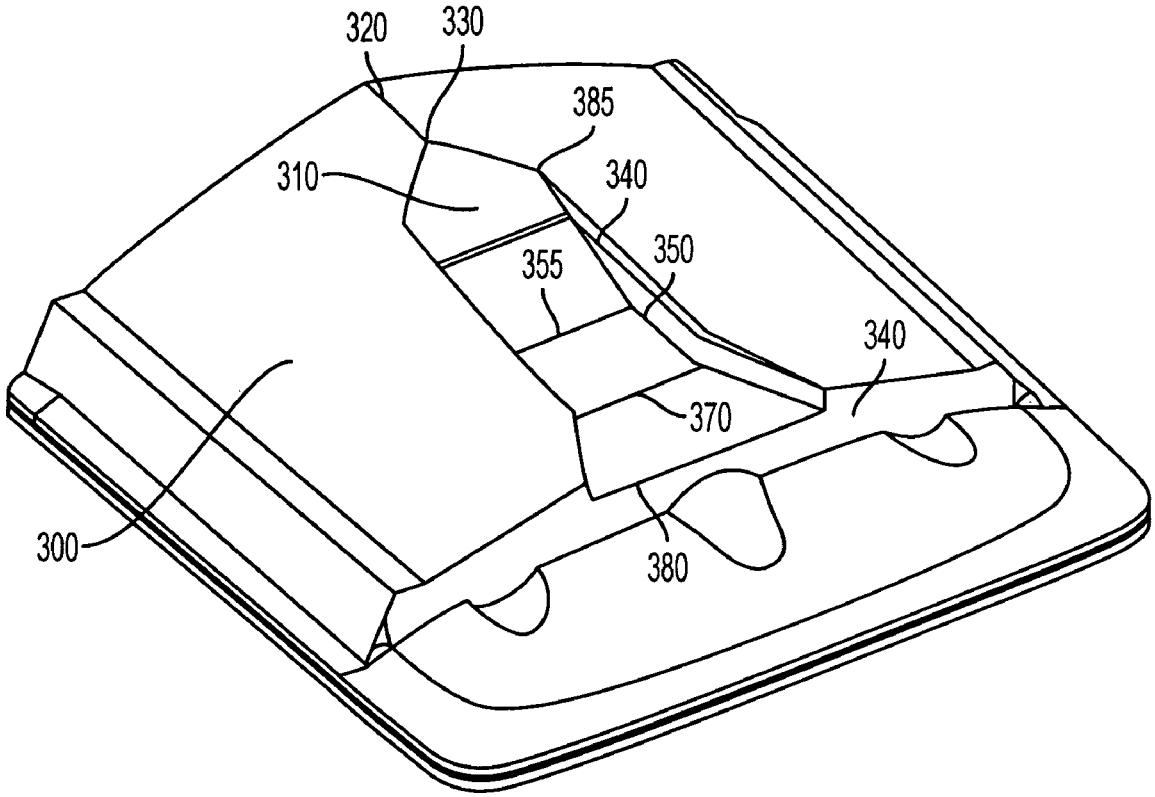
FIG. 3 is a bottom perspective view of a hull showing dimensions and placement for a representative tunnel, according to an embodiment.

As will be appreciated by a review of the suggested swivel angles, propeller types, clearance spaces and swivel drive types, a variety of tunnel configurations may be configured, depending on specific circumstances. A representative tunnel that was built and tested is shown in FIG. 3, which indicates hull bottom surface 300 aft section that surrounds and includes tunnel 310. Tunnel 310 is positioned over centerline 320 and extends aft from point 330 to transom 340. A swivel drive may be centered within the aft half of the tunnel. A sloping ramp section extends from point 330 to line 355 and has a slope angle formed between lines 340 and 350. A flat midsection extends from line 355 to line 370 and a rear section extends from line 370 to transom cutout opening 380. The flat midsection and rear section share a common plane as shown in FIG. 3. The tunnel width in this embodiment is constant from point 385 back to line 370. Aft of line 370 the tunnel flares outward.

The tunnel shown in FIG. 3 should have a flat bottom (horizontal) surface that ramps up in the vessel front to aft direction with a rake angle of 4 to 25 degrees, and more desirably between 7 and 15 degrees. These ranges provide an acceptable tradeoff between drag and tunnel length, which affects buoyancy. The ramp ends (shown as line 355) at a flat, horizontal section (as shown between lines 355 and 370) that contains the swivel axis. Most desirably, the steerable drive is positioned so that the propeller is located on the flat horizontal section between 0 and 2 propeller diameters aft of the end of the ramp, as illustrated, aft of line 355 in the figure. More preferably, the propeller is located between 0.25 and 0.75 propeller diameters aft of the end of the ramp, and optimally at 0.5 propeller diameters aft of the ramp. This optimum is preferred to give the best performance between the tradeoff between performance drag and minimization of buoyancy loss from the tunnel size. The larger spaces provide less drag but more buoyancy.

A flat horizontal hull surface often is desired at the swivel axis location. An embodiment provides a swivel drive mounted within a horizontal, flat surface of a tunnel. Generally, mounting the propeller unit at the forward end closer to line 355 is preferred with an inclined flat tunnel floor immediately in front of the propeller. Mounting the propeller thusly in a front puller configuration often allows greater flexibility in aft tunnel design because less widening of the tunnel opening at the transom line generally is required compared to the situation of aft mounted propeller designs.

Figure 4:
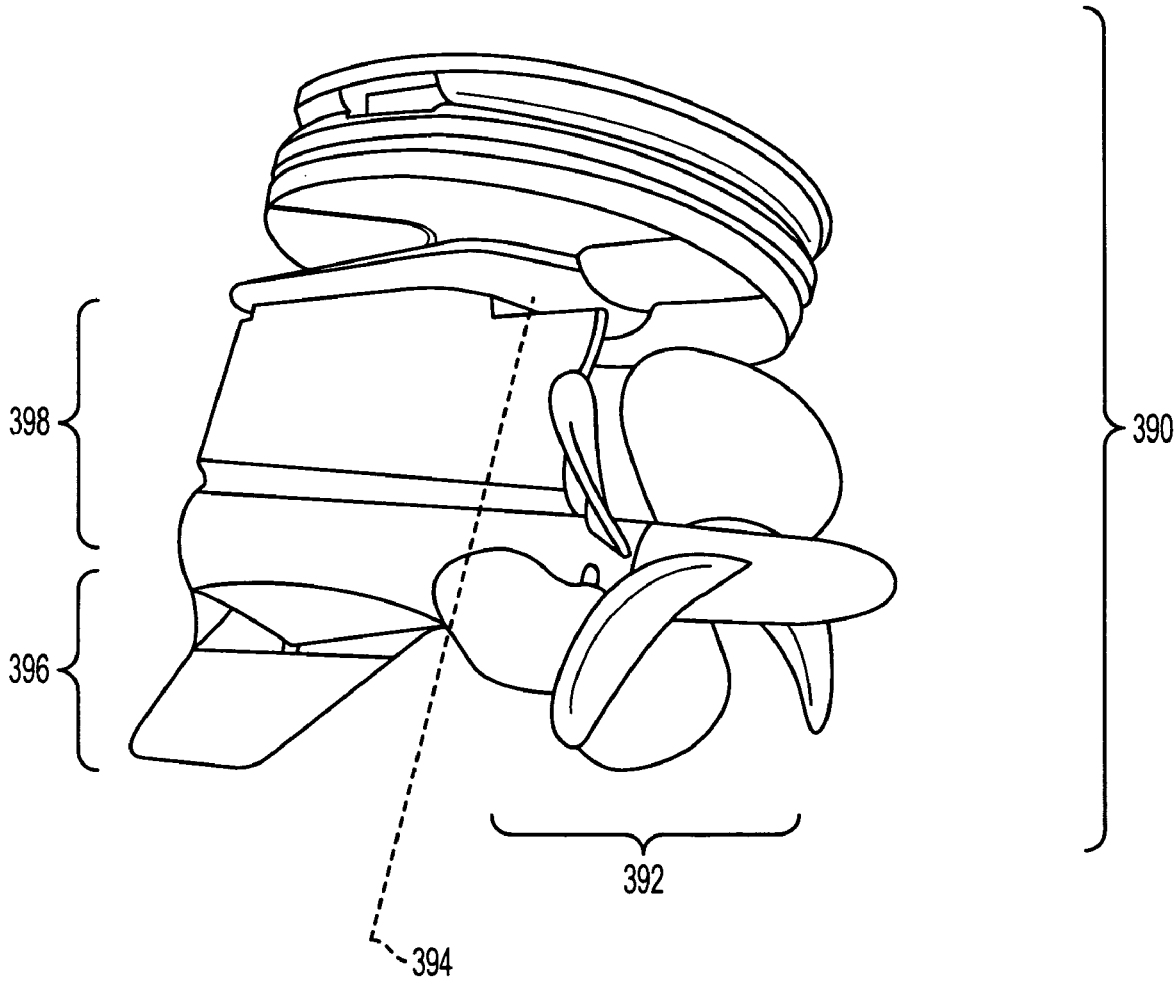
FIG. 4 shows a representative swivel traction drive lower unit.

FIG. 4 shows a swivel drive unit 390 with forward propeller pair 392 that swivels around axis 394 (indicated by the dotted line). Preferably the lower portion 396 (i.e. the portion below the propeller rotation axis) of the submerged has a fore to aft dimension that is shorter than the fore to aft dimension of an upper portion 398 (i.e. above the propeller rotation axis) of the submerged unit. For the purposes of accurate comparison, the average horizontal dimension of the lower portion aft of the swivel axis is shorter than the average horizontal dimension of the upper portion aft of the swivel axis, as exemplified here. Without wishing to be bound by any one theory for this embodiment, it was appreciated that a swivel drive unit having a portion below the propeller axis and aft of the swivel axis that is at least 10% shorter in horizontal dimension than a portion above the propeller axis and aft of the swivel axis allows lower turbulence and allows positioning of a puller drive closer to an aft tunnel surface compared to that of a pusher drive. Desirably, then, the average of the aft lower portion horizontal dimension is at least 10% shorter than the average aft horizontal dimension of the upper portion. Moreover, making the aft lower part of the swivel drive unit shorter than the upper part can provide measurable benefits of yet less turbulence, particularly in configurations where the propeller rotation arc extends at least partly below the tunnel opening. This provides enhanced performance compared to that of a pusher drive, which lacks this physical advantage.

This latter feature of a traction swivel drive may be exploited in combination with a tunnel of narrowed exit opening cross section by allowing rapid exit of water while minimizing hindrance by the aft section pinching off the tunnel wall when the drive is steered at a sharp angle. By contrast, a pusher drive often has a longer horizontal submerged portion aft of the swivel axis. Thus, the embodiment of combined puller drive in swivel configuration in a tunnel can provide enhanced efficiency in comparison to an aft mounted propeller drive in a tunnel since the aft mounted propeller generally requires greater space aft of the swivel drive rotation axis. Lower drag engendering greater watercraft efficiency and higher speed can result from the more continuous tunnel wall and opening of the puller configuration.

In particular and preferably, in a combination of a tunnel with a swivel drive, the tractor drive propeller(s) extend below the bottom (away from the boat hull) of the tunnel by at least 20% of the propeller diameter. Preferably the tunnel is at the centerline and is symmetric with port and starboard walls of equal depth.

In another embodiment the tunnel width is not constant (side walls not parallel) but flares out or widens from front to aft. The tunnel width preferably is not constant from top to bottom (position with respect to the waterline) but may also flare out sideways toward the bottom to form a generally trapezoidal cross section. For example, in an embodiment tested, the tunnel width was 1.4 times the propeller diameter at the top and 1.55 times the propeller diameter at the bottom.

Figure 5:
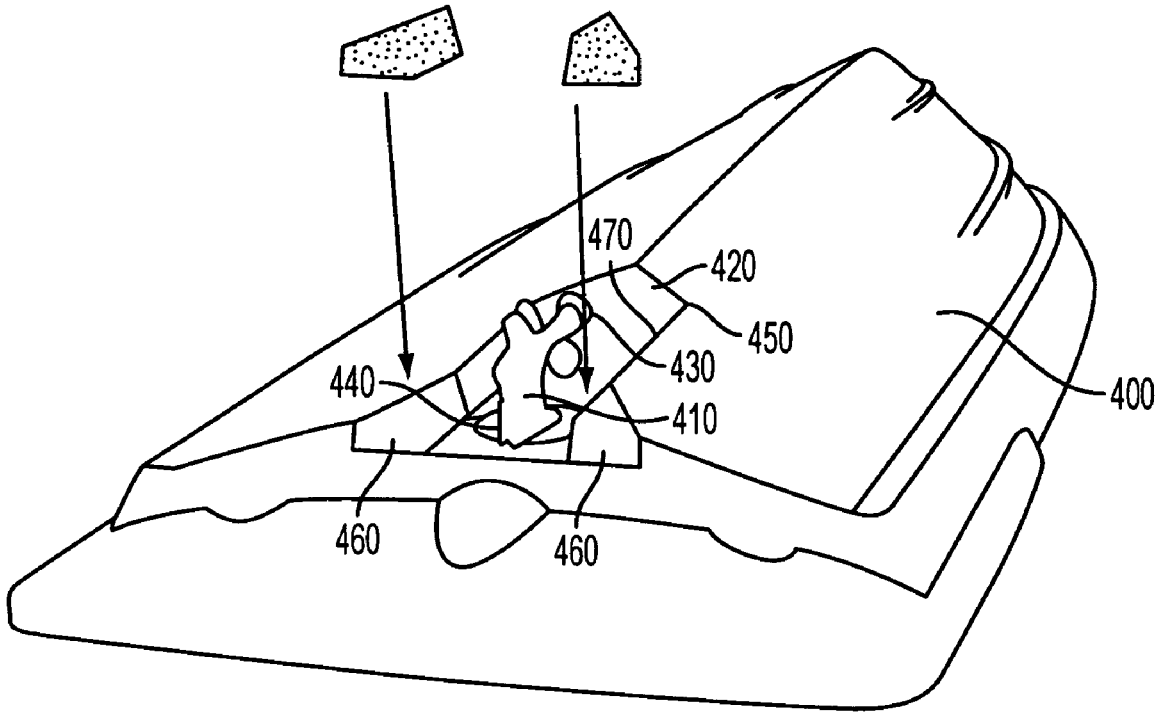
FIG. 5 shows placement of a swivel drive in a tunnel according to an embodiment; and, FIG. 6 shows an alternative embodiment of a tunnel for a swivel drive according to the invention.

FIG. 5 shows further detail of hull bottom 400 with lower unit of swivel traction drive 410 mounted in centrally located tunnel 420. Counter rotating propellers 430 are positioned forward of swivel mount 440. The flat surfaces of mount 440 experience a faster slip stream due to their location downstream of propellers 430 but respond to sideways slipping motion of the watercraft. Mount 440 thus promotes stability by limiting rocking and sliding motion.

At the fore end of the tunnel, corner 450 and the corresponding opposite corner are shown as a sharp defined angle, however, this angle preferably is rounded. Preferably, corner 450 is rounded and dimensioned to maintain a consistent distance from the forward propeller to accommodate the sweep of the propeller steering arc as the propeller is swiveled around the propeller's steering axis.

The aft end of tunnel 420 flares outward at portions 460. FIG. 5 illustrates flare portions, a wall portion 460 and a wall portion 460, which are further illustrated by the depiction of the removed material (removed stippled portions) shown above the flared portions. Because of the angle of view, the removed portions appear to be differently shaped, however, but are mirror images. The exit shape of the tunnel is discussed in more detail below in connection with FIG. 6.

Figure 6:
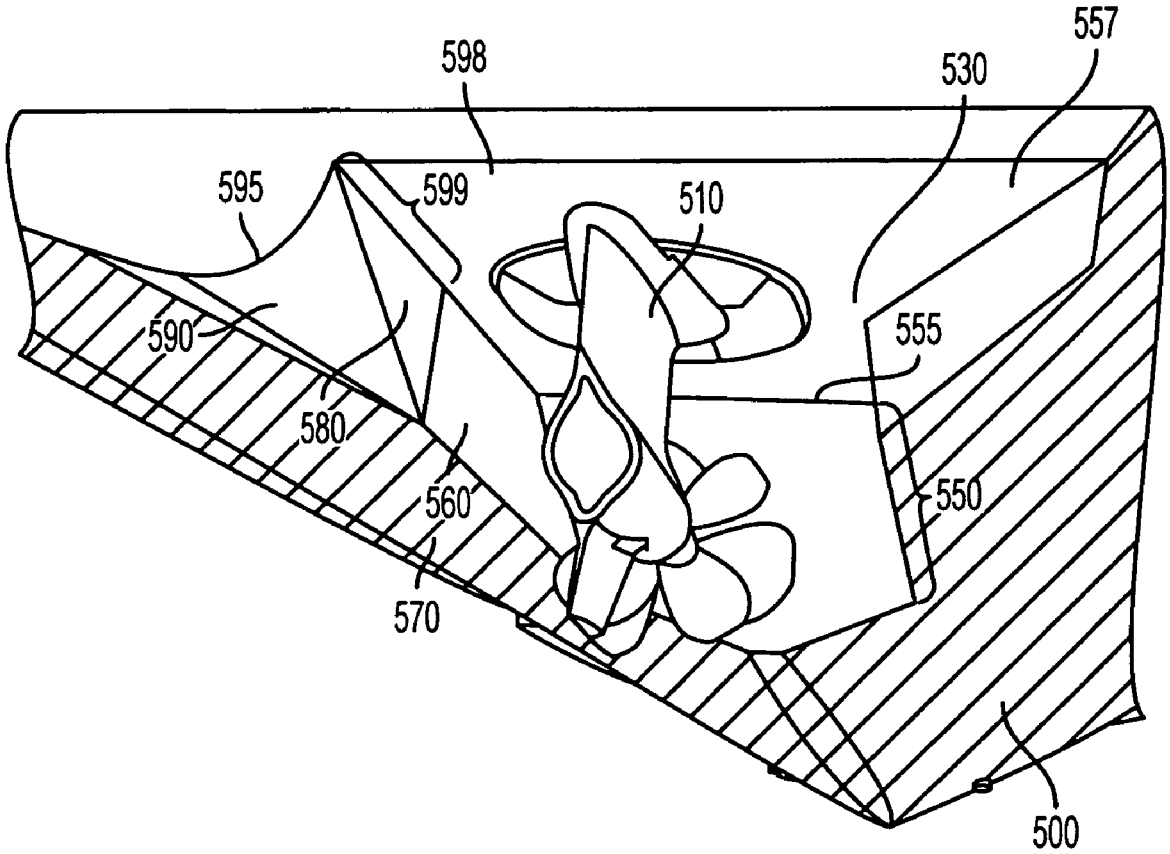

FIG. 6 shows a rear perspective of boat bottom hull 500 having a tunnel 530 (the bottom outside the tunnel being shaded for contrast) with a traction swivel drive 510 mounted in the tunnel. Tunnel front section 550 is an inclined ramp surface that terminates at a flat horizontal midsection at the ramp aft section at line 555. This figure shows a wide right exit corner space 557 created by a flared exit wall portion as described above for FIG. 5. A preferred exit corner that provides a narrower exit opening is shown on the left side of the figure extending along line 599, comprising surfaces 580 and 590 and terminating at aft edge 595.

Vertical wall surfaces 560 and 580 in the preferred exit shape shown on the left side of the figure form the port side of the tunnel area aft of line 555. The four sided vertical wall surface 560 extends vertically downward from the inner flat tunnel surface down to the lower (bottom facing), shaded outside hull surface 570 and horizontally from the ramp portion 550 to the wall surface 580. The contiguous, aft vertical wall surface triangle 580 is a continuation of surface 560 and also is flat and vertical. However, the lower surface 590 of vertical lateral wall surface 580 is a curved surface, which is convex when viewed from below, and forms arc 595 at the extreme aft end, which terminates at transom line 598. In another embodiment (not shown) lateral wall surfaces 560 and 580 (and corresponding walls on the tunnel's other side) are not perfectly vertical but diverge from the top to the bottom by typically 7% to 20%.

Distance 599 along the tunnel axis is shown in FIG. 6 as one propeller diameter, and is recommended to provide a significant amount of swivel freedom. However, in alternative embodiments, distance 599 may be 0.5 to 1 diameters, which provides less swivel freedom but also less tunnel drag. On the other hand, a distance of greater than 1 propeller diameter may be desired in instances where greater swivel is desired, such as when a single swivel drive is used or primarily relied on for steering. The exact distance for an application can be optimized for desired swivel, in view of a propeller mount size and tunnel width. Smaller distances (0.5 to 1 diameters) are preferred for puller drive embodiments, which can accommodate tighter spacing in the rear compared to pusher drives.

The aft exit configuration of the tunnel affects performance and preferably should be curved, which is explained in connection with FIG. 5 and FIG. 6. Tests were carried out to modify the aft end of the central tunnel, as shown in FIG. 5, in which exit corners 460 were formed by removing material from the hull (removed forms shown as dotted blocks). In tests, a watercraft having a tunnel with both aft sides cut away as exemplified in FIG. 5 to form the side corner spaces 460 experienced much turbulence. However, when both tunnel exit corners for the same watercraft were formed as a curved surface 590 as shown in the left side of FIG. 6, turbulence was reduced, while maintaining good watercraft speed efficiency. The preferred tunnel exit, as shown in FIG. 6, is a continuous convex rounded surface with an aft extremity formed as curve section 595. Other shapes, however, may be employed for the aft tunnel flare.

In an embodiment, a swivel pulling tractor drive unit is combined with a tunnel having a shorter aft flared distance 599 compared to that required for a drive that uses a pusher configuration. This shorter flaring distance particularly is made possible by a shorter aft horizontal distance of the submerged drive as compared to a pusher configuration. In an embodiment, a swivel drive within a tunnel has an aft horizontal distance that is shorter than the forward distance by at least 0.25 propeller diameters, as turbulence decreases much within these stated short propeller diameter distances.

Generally, without wishing to be bound by any one theory for this embodiment, a tunnel's dimensions may represent a tradeoff of three partly contradictory needs. One, the tunnel should be as deep as possible to contain the propeller(s). Two, the tunnel should be as narrow as possible to minimize loss in buoyancy, and three; the tunnel should be large enough to accommodate swivelable propeller(s) with sufficient clearance from propeller tips. Desirably, based on experience with propeller positioning near a hull at the expected rotation speeds, clearance should be about 1-7 inches, and more preferably 2-5 inches, and yet more preferably 3-4 inches from tip to hull, as needed, depending on propeller size, to limit vibration. When mounted within a deadrise of 10 to 24 degrees, tip clearance desirably is between 0.5 inches and 4 inches, and more preferably 1 inch.

In an embodiment wherein the propeller protrudes partly out the tunnel bottom, the tunnel width is about 1.2 to 2 propeller diameters wide. Desirably the tunnel is about 1.3 to 1.7 diameters wide and more desirably about 1.4 and 1.6 propeller diameters wide.

In an embodiment that provides enhanced high speed performance, the tunnel is not deep enough to include the entire propeller but is less than one propeller diameter deep. Desirably, the tunnel depth is 40% to 90% of one propeller diameter. More desirably the tunnel depth is 50% to 80% of one propeller diameter, and more preferably is 60% to 70% of one propeller diameter. These particular depths are expressed in units of propeller size because the propeller size dominates the effect of tunnel depth, and the partial protrusion of the propeller from the tunnel, as recited here, represents tradeoffs that were recognized as protecting the propeller by placement within the tunnel, minimizing effect of tunnel on buoyancy, yet placing the propeller as much as possible in an undisturbed flow stream to maintain propeller efficiency.

For example, a 24 inch deep tunnel section may contain a 30 inch diameter propeller and a 15 inch deep tunnel may contain a 19.5 inch diameter propeller. The configuration of a more shallow tunnel is particularly desirable when greater space is needed inside the hull, because the motor can be placed lower in the hull when the propeller is lower. In an embodiment, a motor that powers the propulsion drive is located very close to the hull bottom such that the oil pan is within 6 inches or less of the bottom for best space usage. By combining this localization with a lower propeller that protrudes beyond the tunnel space, greater hull volume utilization is achieved.

Removal of air from the Tunnel

A tunnel mounted drive preferably expels exhaust gas through the propeller hub. This gas was found to collect in an air pocket in the tunnel, causing propeller cavitation. In an embodiment, the tunnel bottom is curved and/or includes a modified surface to discourage such accumulation of exhaust gas within the tunnel. A convex shaped tunnel bottom that curves upward from fore to aft, can help prevent gas accumulation and particularly is preferred. The convex shape may assume the form of two or more straight sections of surfaces that are not exactly horizontal, but that allow buoyant travel of air away from the propeller and minimize air pocket formation.

In a desirable embodiment, the tunnel bottom is ribbed in a direction substantially along the centerline to encourage gas removal. The ribs preferably are indentations with respect to the hull surface, although they may alternatively be formed as raised surfaces. In an embodiment, one rib is made at each of the starboard and port sides of the tunnel, at the junction where the vertical wall (which may not be completely vertical) meets the tunnel bottom. These edge ribs desirably are between 0.25 and 8 inches wide, preferably between 0.5 and 8 inches wide and between 0.25 and 6 inches deep, and preferably between 0.5 and 4 inches, and more preferably between 1 and 3 inches deep. These dimensions are chosen based on the experienced and expected sizes of air pockets that accumulated during tests. In another embodiment ribs are present in the middle of the tunnel and extend to both sides of the propeller mount. In an embodiment a large central rib extends at the centerline aft from the tunnel drive.

Other Triple Drive Considerations

Triple drive systems were studied and several advantages appreciated when used in combination with front traction propulsion. In embodiments, engine room volume is decreased, planing vessel top speed is increased and maneuverability can be enhanced, in comparison to regular non-swivel double drive configurations or even compared to double swivel drive configurations.

In one working example, a Tiara 4400 Sovran, having two 715 horsepower diesel powered drives was converted by replacing the two drives with three 370 horsepower engines coupled to swivel drives with double propellers mounted in front, as depicted in FIG. 1A. The triple drive configuration provided approximately 10% higher top speed on less power. Furthermore, the triple drive engine room occupied approximately only 15% of the hull volume, while the double drive occupied approximately 25% of the hull volume. The calculation of engine room volume is carried out by customary measurements that ignore the thickness of walls and includes the space inside the engine room walls.

In this regard, replacement of dual drives of a planing vessel with three drives provides an engine room that can be more than 50% smaller in volume compared to the engine room before modification because of the shorter length to width ratio with smaller drives. In an embodiment, the two original drives are swivel drives and are replaced with three swivel drives.

A propulsion conformation of a third swivel drive in a centerline tunnel provides enhanced reliability. Many planing vessel installations employ two drives, one on each side of the watercraft centerline. When one drive becomes inoperable, steering becomes very difficult. The three swivel drive configurations described herein alleviate this problem by allowing significant steering ability when one or two drives are disabled.

All cited references specifically are incorporated by reference in their entireties. The descriptions above and the accompanying drawings should be interpreted in the illustrative and not the limited sense. While the invention has been disclosed in connection with most desirable embodiments, it should be understood that other embodiments fall within the scope of the invention as defined by the following claims.

What is claimed is:

1. A planing watercraft, comprising a hull having a starboard hull section and a port hull section meeting at a centerline, a tunnel formed at the centerline, and a traction swivel drive with at least one attached propeller mounted in the tunnel, wherein the tunnel has a forward sloping ramp section, a rear section that opens out at least partly into a cross section of the watercraft transom and a mid section contiguous to and positioned between the forward sloping ramp section and the rear section, wherein the rear section of the tunnel comprises vertical lateral wall surfaces from the midsection to the transom and wherein the vertical lateral wall surfaces diverge from a centerline of the tunnel through a distance of between 0.5 to 1.5 propeller diameters in size along the centerline adjacent to the transom opening, wherein the swivel drive has a vertical swivel axis located within the mid section, and wherein the at least one propeller is located not more than 2 propeller diameters aft of a junction between the forward ramp and the mid section.

2. The planing watercraft of claim 1, wherein the tunnel has a depth between 50% and 80% of one propeller diameter.

3. The planing watercraft of claim 1, wherein the tunnel has a forward sloping ramp section having a mean ramp angle between 4 and 25 degrees.

4. The planing watercraft of claim 3, wherein the forward sloping ramp section of the tunnel is straight and has a ramp angle between 12 and 17 degrees.

5. The planing watercraft of claim 1, wherein the rear section of the tunnel defines an opening area at the transom having a cross section that is greater than a mean cross sectional area of the mid section at the location of the swivel drive vertical axis.

6. The planing watercraft of claim 1, wherein an upper surface of the tunnel is formed with ribs extending from the fore end to the aft end to facilitate the exhaust of air from the tunnel space.

7. The planing watercraft of claim 1, further comprising trim tabs on the swivel drive.

8. The planing watercraft of claim 1, further comprising trim tabs on the swivel drive.

9. The planing watercraft of claim 1, wherein the forward sloping ramp section of the tunnel has a mean ramp angle between 4 and 25 degrees.

10. The watercraft of claim 1, wherein the rear section of the tunnel defines an opening area at the transom having a cross section that is greater than a mean cross sectional area of the mid section at the location of the swivel drive vertical axis.

11. The planing watercraft of claim 1, wherein the propellers of the first swivel drive, second swivel drive and third swivel drive are located on substantially a common horizontal plane.

12. The watercraft of claim 1, wherein the tunnel has an exit defined by walls formed with a continuous convex rounded surface with an aft extremity formed as a curved section.

13. A planing watercraft, comprising:

a hull having a starboard hull section and a port hull section meeting at a centerline and a transom at a rear of the hull;

a tunnel formed at the centerline, the tunnel having a forward sloping ramp section, rear section that opens out at least partly into a cross section of the transom, and a mid section contiguous to and positioned between the forward sloping ramp section and the rear section;

a first swivel drive with at least one attached propeller mounted in the tunnel with a vertical swivel axis located within the mid section of the tunnel;

a second swivel drive with at least one attached propeller mounted in the starboard hull section; and;

a third swivel drive with at least one attached propeller mounted in the port hull section, wherein the rear section of the tunnel defines an opening area at the transom having a cross section that is greater than a mean cross sectional area of the mid section at the location of the swivel drive vertical axis, wherein the rear section of the tunnel comprises vertical lateral wall surfaces from the midsection to the transom and wherein the vertical lateral wall surfaces diverge from the centerline through a distance of between 0.5 to 1.5 propeller diameters in size along the centerline adjacent to the transom opening.

14. The planing watercraft of claim 13, wherein the swivel drives are traction drives.

15. The planing watercraft of claim 13, wherein each swivel drive independently swivels.

16. The planing watercraft of claim 13, wherein each of the swivel drives comprises two propellers.

17. The planing watercraft of claim 13, further comprising a second tunnel formed in the starboard hull section in which the second swivel drive is mounted and a third tunnel formed in the port hull section in which the third swivel drive is mounted.

18. The planing watercraft of claim 13, wherein the watercraft lacks a rudder and the swivel drives provide steering.

19. The planing watercraft of claim 13, wherein said swivel drives each comprise an elongated submerged portion and counter-rotating propellers mounted on a forward end of the submerged portion.

20. The planing watercraft of claim 13, wherein the swivel drives and their associated motors are confined to the rear 20 percent of hull length.

21. The planing watercraft of claim 13, having an engine room, wherein the engine room volume to internal vessel volume is less than 20%.

22. The planing watercraft of claim 13, wherein the tunnel has a depth between 50% and 80% of one propeller diameter.

23. The planing watercraft of claim 13, wherein the tunnel has a forward sloping ramp section having a mean ramp angle between 4 and 25 degrees.

24. The planing watercraft of claim 13, wherein the forward sloping ramp section of the tunnel is straight and has a ramp angle between 12 and 17 degrees.

* * * * *